US012180574B1

(12) United States Patent
Esposito et al.

(10) Patent No.: US 12,180,574 B1
(45) Date of Patent: Dec. 31, 2024

(54) TARNISH RESISTANT AND AGE HARDENABLE STERLING SILVER ALLOY

(71) Applicants: Joseph Esposito, Wakefield, RI (US); Grigory Raykhtsaum, Sharon, MA (US)

(72) Inventors: Joseph Esposito, Wakefield, RI (US); Grigory Raykhtsaum, Sharon, MA (US)

(73) Assignees: National Chain Company, Warwick, RI (US); Enewton Design, LLC, Atlanta, GA (US)

( * ) Notice: Subject to any disclaimer, the term of this patent is extended or adjusted under 35 U.S.C. 154(b) by 0 days.

(21) Appl. No.: 18/791,611

(22) Filed: Aug. 1, 2024

(51) Int. Cl.
*C22C 5/08* (2006.01)

(52) U.S. Cl.
CPC ..... *C22C 5/08* (2013.01)

(58) Field of Classification Search
CPC ..... C22C 5/08
See application file for complete search history.

(56) References Cited

U.S. PATENT DOCUMENTS

| | | | | |
|---|---|---|---|---|
| 1,590,091 | A | 6/1926 | Heusler | |
| 5,037,708 | A | 8/1991 | Davitz | |
| 6,168,071 | B1 | 1/2001 | Johns | |
| 6,726,877 | B1 * | 4/2004 | Eccles | C22C 5/08 420/502 |
| 7,198,683 | B2 | 4/2007 | Agarwal et al. | |
| 8,136,370 | B2 | 3/2012 | Bennett | |
| 9,200,350 | B2 | 12/2015 | Copponex et al. | |
| 9,217,190 | B2 | 12/2015 | Butler | |
| 9,267,191 | B2 | 2/2016 | Raykhtsaum | |
| 10,697,044 | B1 | 6/2020 | Butler | |
| 10,876,189 | B2 | 12/2020 | Bertoncello et al. | |
| 2019/0003015 | A1 * | 1/2019 | Bertoncello | C22F 1/14 |

OTHER PUBLICATIONS

G. Raykhtsaum, "Sterling Silver—U.S. Patent Review," The Santa Fe Symposium on Jewelry Manufacturing Technology, 2014, pp. 403-416.

* cited by examiner

*Primary Examiner* — Anthony M Liang
*Assistant Examiner* — Danny N Kang
(74) *Attorney, Agent, or Firm* — Salter & Michaelson

(57) ABSTRACT

A sterling silver alloy composition consisting of in parts by weight:
at least 92.5% silver,
0.5%-1.2% palladium,
3.4%-4.8% copper,
0.5%-1.5% zinc,
0.1%-1.5% indium,
wherein zinc and indium combined content is not greater than 2.4%,
0.3%-1% germanium,
and
0.005%-0.05% silicon.

6 Claims, 3 Drawing Sheets

TARNISH RESISTANT AND AGE HARDENABLE STERLING SILVER ALLOY

TECHNICAL FIELD

The present invention relates in general to sterling silver alloys, and more particularly to an improvement in tarnish resistant sterling silver alloys.

BACKGROUND OF THE INVENTION

Sterling silver was legally defined in 13$^{th}$ century England as a binary alloy that contains by weight 92.5% silver and 7.5% copper. This alloy has always been known for its susceptibility to tarnish by readily forming silver and copper sulfides as well as copper oxides. This definition was changed with time to just about any alloy that contains at least 92.5% silver. This was driven by numerous attempts to improve tarnish behavior and mechanical properties of sterling silver by replacing all or a portion of copper with other multiple elements. One of the first such documented attempt was described in the U.S. Pat. No. 1,590,091 issued in 1926. A fairly comprehensive elemental analysis of US patents related to sterling silver alloys issued between 1926 and 2014 was presented by the author in: G. Raykhtsaum, "Sterling Silver—U.S. Patent Review", The Santa Fe Symposium on Jewelry Manufacturing Technology, 2014, 403-416.

In accordance with the present invention the additions of two elements to silver, namely palladium and germanium, are found to be especially effective in suppressing the rate of tarnish. See Table 1 below for a list of existing US patents that teach additions of palladium or germanium to sterling silver compositions.

mentioned. These alloys are not economical due to the high content of expensive palladium.

U.S. Pat. No. 6,168,071 teaches ternary silver-germanium-copper alloys containing at least 77% by weight copper, germanium in the range between 0.4% and 7% by weight and balance copper. Palladium is not present in these alloys. These alloys have been originally patented as brazing alloys, and eventually, become the base for creating a very popular jewelry sterling silver called "Argentium". This patent also teaches age hardening due to silver-germanium system. These alloys show extensive germanium-rich phase segregations during continuous casting that becomes an issue for mass manufacturing.

U.S. Pat. Nos. 6,726,877 and 7,198,683 both teach smaller additions of germanium (among other elements present) in the range between 0.01% and 2% by weight as an enhancer of resistance to tarnish. No palladium is present in these alloys.

U.S. Pat. No. 8,136,370 teaches even higher palladium content between 5% and 15% by weight. These alloys are also age hardenable due to silver-copper and palladium-copper systems—a feature that is not mentioned. Again, high palladium content drives the cost significantly higher.

U.S. Pat. No. 9,200,350 teaches reduced palladium content from 0% to 1% by weight, and lists copper at the level of impurity between 0% and 0.02% by weight. Germanium is added between 0.7% and 1.65% by weight. The practical absence of copper makes these alloys tarnish resistant. Tarnish resistance is enhanced by presence of germanium. These alloys do not show appreciable age hardening.

U.S. Pat. No. 9,217,190 introduces sterling silver alloy that contains a narrow palladium range between 2.75% and 2.8% by weight, 3% by weight copper, 0.75% by weight

TABLE 1

| | Patent | | | | | | | | |
|---|---|---|---|---|---|---|---|---|---|
| | 5,037,708 | 6,168,071 | 6,726,877 | 9,198,683 | 8,136,370 | 9,200,350 | 9,217,190 | 9,267,191 | 10,876,189 |
| Issue Date | Aug. 6, 1991 | Jan. 2, 2001 | Apr. 27, 2004 | Apr. 3, 2007 | Mar. 20, 2012 | Dec. 1, 2015 | Dec. 22, 2015 | Feb. 23, 2016 | Dec. 29, 2020 |
| Assignee | Davitz | Johns | Eccles | Richline | ABI | Johnson Matthey | Stuller | Richline | Legor |
| Ag | 80-92.5 | ≥77 | 81-95.4 | ≥92.5 | 75-85 | ≥95 | ≥92.5 | ≥92.5 | 92.5-96.8 |
| Pd | 4-9 | | | | 5-15 | 0-1 | 2.75-2.8 | 2-2.4 | 0.7-1.9 |
| Au | | | | | 0-4 | | | | |
| Pt | | | | | 0-2 | | | | |
| Ru | | | | | | | 0.005 | | |
| Cu | 2-10 | balance | 0.5-6 | 5-5.25 | 3-6 | 0-0.02 | 3 | 3.7-5 | 0-3 |
| Zn | | | | 0-1 | 0-2 | | 0.75 | 0-1.5 | |
| In | | | 0.01-1.5 | | | 1.3-1.8 | | | |
| Zn or In | 0.5-1 | | | | | | | | |
| Zn + In | | | | | | | | | 2.5-6.8 |
| Ga or In | | | | | 0.5-2 | | | | |
| Sn | | | | 0.85 | 0-2 | | 1 | | |
| Sn or Ga | | | | | | | | | 0-2 |
| Ge | | 0.4-7 | 0.01-2 | 0-1.2 | | 0.7-1.65 | | | |
| Si | | | 0.02-2 | 0.05-0.5 | 0-0.2 | | | 0-0.1 | |
| Zn + Si | | | 0.07-6 | | | | | | |
| Ge or Si | | | | | | | | | 0-0.25 |
| B | | | | 0-0.01 | | 0-0.015 | | 0-0.02 | |
| Li | | | | 0.05 | | | | | |

The following are comments pertain to the above patents.

U.S. Pat. No. 5,037,708 teaches the additions of palladium in the range between 4% and 9% by weight with no additions of geranium. The patent claims that these alloys feature exceptional resistance to tarnish. Apparently, these alloys can be age hardened due to silver-copper and palladium-copper systems, although the hardening part is not zinc, 1% by weight tin, and 0.005% ruthenium (most likely as a grain refiner). These alloys contain no germanium.

U.S. Pat. No. 9,267,191 teaches similar sterling silver alloys that contain slightly reduced palladium range between 2% and 2.4% by weight, somewhat higher copper between 3.7% and 5% by weight, 0%-1.5% by weight zinc, 0-0.1% by weight silicon and 0%-0.02% by weight boron (improves fluidity). These alloys do not contain germanium.

Finally, U.S. Pat. No. 10,876,189 teaches sterling silver alloys containing palladium from 0.7% to 1.9% by weight, lists copper between 0% and 3% by weight, and introduces germanium or silicon between 0% and 0.25% (practically as deoxidizers), from 0% to 2% by weight tin or gallium, and combined content of zinc and indium in the wide range between 2.5% and 6.8% by weight. The patent does not teach the presence of germanium as an enhancer of resistance to tarnish, apparently because even 0.25% of germanium is not enough to show an appreciable effect.

In all patents listed above the other non-precious elements that are present may serve the following functions:

Zinc (Zn)—is a deoxidizer, and also contributes to resistance to tarnish.

Tin (Sn)—increase the hardness.

Gallium (Ga)—lowers the melting temperature (mainly the solidus).

Silicon (Si)—is a deoxidizer.

Boron (B)—is a deoxidizer, and also improves the fluidity that is critical for investment casting.

Indium (In)—may contribute to hardening by forming intermetallic compound with palladium, and often is used as a ballast element.

Lithium (Li) is a deoxidizer, and also forms intermetallic compound with tin that improves age hardening.

OBJECTIVE OF THE PRESENT INVENTION

The objective of present invention is to derive palladium and germanium containing sterling silver alloys that feature the following:

The minimum economically optimized palladium content in combination with an adequate amount of germanium to provide the enhanced tarnish resistance that is either better or comparable to that of the alloys of the prior art.

The adequate copper content ensures effective age hardening due to silver-copper and palladium-copper systems.

The minimum combined content of zinc and indium as these elements play secondary roles in sterling silver alloys properties.

Minimum amount of silicon that ensures the deoxidizing effectiveness, and at the same time reduces the chance of formation of palladium silicide that may appear as hard spots while polishing cast jewelry.

No additions of gallium, as it not only lowers the solidus temperature that may lead to premature material breaks during high temperature annealing, but also widens the melting solidus-liquidus range which may lead to some casting defects such as porosity during investment casting.

No additions of tin, as the increase in hardness may affect the workability of the alloy.

SUMMARY OF THE INVENTION

In accordance with the present invention there is provided a Sterling silver alloy composition consisting of in parts by weight:

at least 92.5% silver,
0.5%-1.2% palladium,
3.4%-4.8% copper,
0.5%-1.5% zinc,
0.1%-1.5% indium,
wherein zinc and indium combined content is not greater than 2.4%,
0.3%-1% germanium,
and
0.005%-0.05% silicon.

In accordance with other aspects of the present invention

The composition of the above claim wherein palladium and germanium combined content is not greater than about 1.5%.

The composition of the above claim wherein the palladium content is about 1%.

The composition of the above claim wherein silicon content is about 0.035%.

In accordance with still another version of the present invention there is provided a Sterling silver alloy composition comprised of in parts by weight:

at least 92.5% silver,
0.5%-1.2% palladium,
3.4%-4.8% copper,
0.5%-1.5% zinc,
0.1%-1.5% indium,
including 0.3%-1% germanium,
wherein zinc and indium combined content is not greater than 2.4%,
and
0.005%-0.05% silicon.

The composition of the above claim wherein palladium and germanium combined content is not greater than about 1.5%.

The composition of the above claim wherein the palladium content is about 1%.

The composition of the above claim wherein the silicon content is about 0.035%.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PRESENT INVENTION

Figure 1:
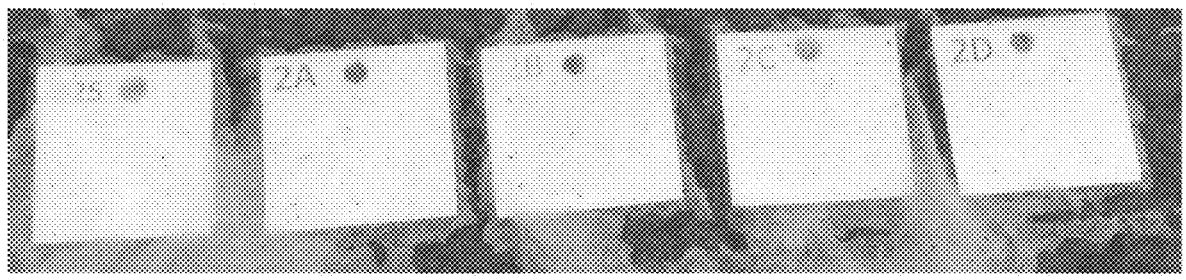
FIG. 1: Diagram 1 shows the original color of the samples from left to right: traditional 925 sterling silver, sample of alloy A, sample of alloy B, sample of alloy C and sample of alloy D. All the samples appear to have identical bright white colors typical for common sterling silver alloys.
Figure 2:
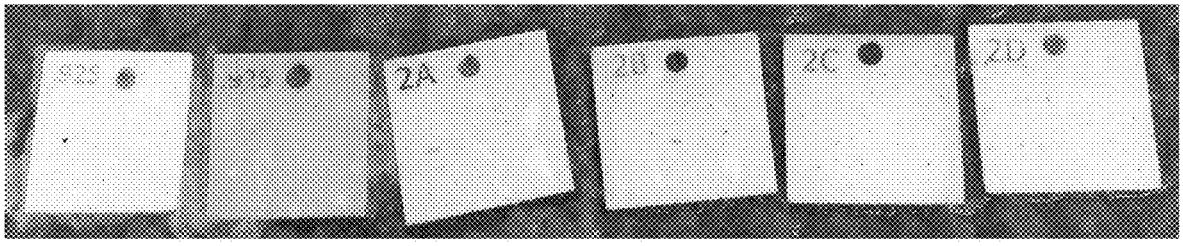
FIG. 2: Diagram 2 shows the color of the samples from left to right: untarnished traditional sterling silver 925 was placed next to tarnished samples for comparison, and the color of the tarnished samples after 10 minutes of test: traditional sterling silver 925, and samples of the alloys A, B C and D.
Figure 3:
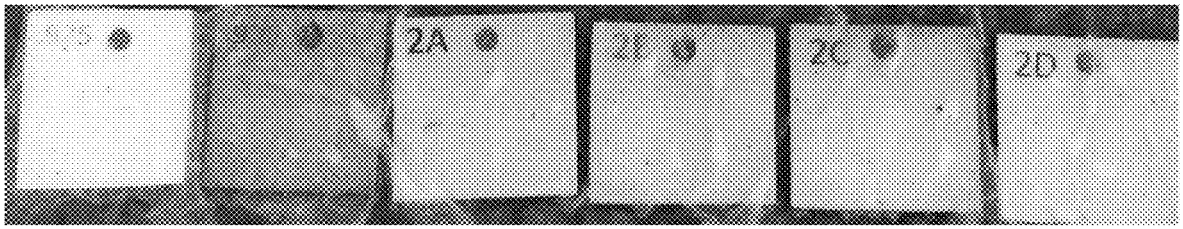
FIG. 3: Diagram 3 shows the color of the samples from left to right: untarnished traditional sterling silver 925 was placed next to tarnished samples for comparison, and the color of the tarnished samples after additional 20 minutes (30 minutes total) of test: traditional sterling silver 925, and samples of the alloys A, B C and D.

In the preferred first embodiment the invention alloy compositions consist of the following percentage by weight: at least 92.5% silver, about 0.5% to 1.2% palladium, about 3.4% to 4.8% copper, about 0.5% to 1.5% zinc, about 0.1% to 1.5% indium wherein zinc and indium combined content is not greater than 2.4%, about 0.3% to 1.0% germanium and about 0.005% to 0.05% silicon (as deoxidizer) wherein germanium and silicon are both present in the alloy. Naturally, the smaller palladium content the less expensive is the alloy. However, reduction in palladium content leads to the reduction in the resistance to tarnish. Such a reduction in the resistance to tarnish can be restored by increasing the germanium content. We have found that keeping the palladium and germanium combined content to about 1.5% by weight in the preferred embodiment maintains the enhanced resistance to tarnish of the alloys of the present invention without affecting the manufacturability (due to potential germanium segregation in the alloy) and the age hardening feature. Furthermore, we believe that palladium content of about 1% by weight ensures practical compromise between the alloy cost and resistance to tarnish and effectiveness of the palladium-copper age hardening mechanism.

There is now set forth a table of the preferred alloy described herein.

| PREFERRED ALLOY | |
|---|---|
| CLAIM 1 | |
| Ag | at least 92.5% silver |
| Pd | 0.5% to 1.2% palladium |
| Cu | 3.4% to 4.8% copper |
| Zn | 0.5% to 1.5% zinc |
| In | 0.1% to 1.5% indium |
| Zn + In | combination of total of zinc and indium not greater than 2.4%-2.4% or less |
| Ge | 0.3% to 1.0% germanium |
| Si | 0.005% to 0.05% of silicon |
| Claim 2 | combined Pd and Ge not greater than 1.5%-1.5% or less |
| Claim 3 | Pd on the order of 1.0% |
| Claim 4 | Si on the order of 0.035% |

Table 2 that is set forth below lists four compositions identified as A, B, C, and D as examples of the alloys of the preferred embodiment. The silver, palladium and silicon contents in all four alloys are kept by weight at 92.5%, 1% and 0.035% respectively. Alloy A composition in addition to silver, palladium and silicon also includes 3.665% copper by weigh (balance), 1% by weight zinc, 1.3% weight indium and 0.5% by weight germanium. Alloy B composition in addition to silver, palladium and silicon also includes 4.665% by weight copper (balance), 0.6% by weight zinc, 0.7% by weight indium and 0.5% by weight germanium. Alloy C composition in addition to silver, palladium and silicon also includes 4.165% by weight copper (balance), 1.5% by weight zinc, 0.3% by weight indium and 0.5% by weight germanium. Alloy D composition in addition to silver, palladium and silicon also includes 3.8% by weight copper (balance), 1.2% by weight zinc, 1.2% by weight indium and 0.3% by weight germanium.

All four alloys were subjected to an accelerated tarnish test against traditional sterling silver containing 92.5% by weight silver and 7.5% by weigh copper. All four alloys exhibited a significantly lower rate of tarnish compared to traditional sterling. All four alloys showed a similarity in tarnish behavior, and all four showed excellent resistance to tarnish. The tarnish test is described below.

TABLE 2

| Element | A | B | C | D |
|---|---|---|---|---|
| Ag | 92.5 | 92.5 | 92.5 | 92.5 |
| Pd | 1 | 1 | 1 | 1 |
| Cu | 3.665 | 4.665 | 4.165 | 3.80 |
| Zn | 1 | 0.6 | 1.5 | 1.2 |
| In | 1.3 | 0.7 | 0.3 | 1.2 |
| Ge | 0.5 | 0.5 | 0.5 | 0.3 |
| Si | 0.035 | 0.035 | 0.035 | 0.035 |

Tarnish Test

Four alloys A, B, C and D along with the traditional sterling silver were cast and rolled down to a thickness of about 0.040". About 1"×1" square samples were cut out and both flat surfaces of each sample were highly polished. All the samples were ultra-sonically rinsed in DI water and then in Isopropanol to ensure that all the polishing compound residue is removed. The samples then were simultaneously submersed into a strong solution of sodium sulfide Na2S. The color of the samples was evaluated visually before the test, and then after 10 minutes and after additional 20 minutes (30 minutes total) of submersion. The samples color was visually evaluated through the wet tissue that was placed on the sample surfaces to eliminate the mirror reflections from highly polished sample surfaces. Diagrams 1-3 illustrate the color of original samples, and the samples color change during tarnishing:

Diagram 1 shows the original color of the samples from left to right: traditional 925 sterling silver, sample of alloy A, sample of alloy B, sample of alloy C and sample of alloy D. All the samples appear to have identical bright white colors typical for common sterling silver alloys.

Diagram 2 shows the color of the samples from left to right: untarnished traditional sterling silver 925 was placed next to tarnished samples for comparison, and the color of the tarnished samples after 10 minutes of test: traditional sterling silver 925, and samples of the alloys A, B C and D.

Diagram 3 shows the color of the samples from left to right: untarnished traditional sterling silver 925 was placed next to tarnished samples for comparison, and the color of the tarnished samples after additional 20 minutes (30 minutes total) of test: traditional sterling silver 925, and samples of the alloys A, B C and D.

It is evident that while the traditional sterling silver turns completely dark-gray after 30 minutes of submersion into the solution of sodium sulfide, all four samples of alloys A, B, C and D still maintain even whitish tint indicating the significantly lower rate of tarnish, and therefore excellent resistance to tarnish.

Having now described a limited number of embodiments of the present invention, t should now be apparent to those skilled in the art that numerous other embodiments and modifications thereof are contemplated as falling within the scope of the present invention, as defined by the appended claims.

The invention claimed is:

1. A sterling silver alloy composition consisting of in parts by weight:

at least 92.5% silver,
0.5%-1.2% palladium,
3.4%-4.8% copper,
0.5%-1.5% zinc,
0.1%-1.5% indium,
wherein zinc and indium combined content is not greater than 2.4%,
0.3%-1% germanium,
and
0.005%-0.05% silicon.

2. The composition of claim 1 wherein palladium and germanium combined content is not greater than about 1.5%.

3. The composition of claim 1 wherein the palladium content is about 1%.

4. The composition of claim 1 wherein silicon content is about 0.035%.

5. The composition of claim 2 wherein the palladium content is about 1%.

6. The composition of claim 5 wherein the silicon is about 0.035%.

* * * * *